US008021027B2

(12) United States Patent
Galipeau et al.

(10) Patent No.: US 8,021,027 B2
(45) Date of Patent: Sep. 20, 2011

(54) LED BASED ACORN STYLE LUMINAIRE

(75) Inventors: Guy Galipeau, Ste. Therese (CA); Michel Fortin, Ste-Marthe-sur-le-lac (CA); Jean-Francois Laporte, Laval (CA); Jonathan Hardy, Montreal (CA)

(73) Assignee: Philips Electronics Ltd, Markham, Ontario (CA)

( * ) Notice: Subject to any disclaimer, the term of this patent is extended or adjusted under 35 U.S.C. 154(b) by 324 days.

(21) Appl. No.: 12/205,568

(22) Filed: Sep. 5, 2008

(65) Prior Publication Data

US 2010/0061091 A1 Mar. 11, 2010

(51) Int. Cl.
*F21S 8/00* (2006.01)

(52) U.S. Cl. ..... 362/431; 362/410; 362/311.02; 362/363; 362/373; 362/294

(58) Field of Classification Search ..... 362/431, 362/410, 311.02, 311.12, 363, 373, 294
See application file for complete search history.

(56) References Cited

U.S. PATENT DOCUMENTS 7,025,480 B2 * 4/2006 De'Armond ..... 362/432
2008/0013306 A1 * 1/2008 Guilmette ..... 362/183

* cited by examiner

*Primary Examiner* — Jong-Suk (James) Lee
*Assistant Examiner* — Leah S Lovell

(57) ABSTRACT

A conventional acorn style globe is described incorporating the utilization of LED's as an illumination source. A supporting heat dissipation plate is provided which extends to the exterior periphery of the acorn style luminaire allowing heat to transfer from the LED's directly to the exterior of the acorn style luminaire while maintaining the integrity of an acorn style globe construction. A plurality of individually orientable lenses on each of the LED's positioned within the interior of the globe allow for efficient downlight and desirable optical characteristics. Interior access may be provided through removal of the globe top to thereby provide accessibility to the LED board mounted on the heat transfer plate.

12 Claims, 9 Drawing Sheets

LED BASED ACORN STYLE LUMINAIRE

BACKGROUND OF THE INVENTION

1. Field of the Invention

The present invention is related generally to acorn style luminaires and more particularly to acorn style luminaires which utilize as a light source LED based illumination devices.

2. Description of the Related Art

Acorn style luminaires have been known in the industry for many years. Traditional acorn style luminaires have utilized incandescent or other high intensity discharge (HID) based illumination devices. It has been problematic in the past to implement incorporation of LED based illumination sources into acorn style luminaires for many reasons. Some of these reasons include re-lamping issues, maintenance issues, internal construction, power supply, access as well as heat dissipation.

BRIEF DESCRIPTION OF THE FIGURES

The various embodiments are depicted in the attached figures in which like numerals refer to like elements and wherein.

DETAILED DESCRIPTION OF THE VARIOUS EMBODIMENTS DEPICTED

Figure 1:
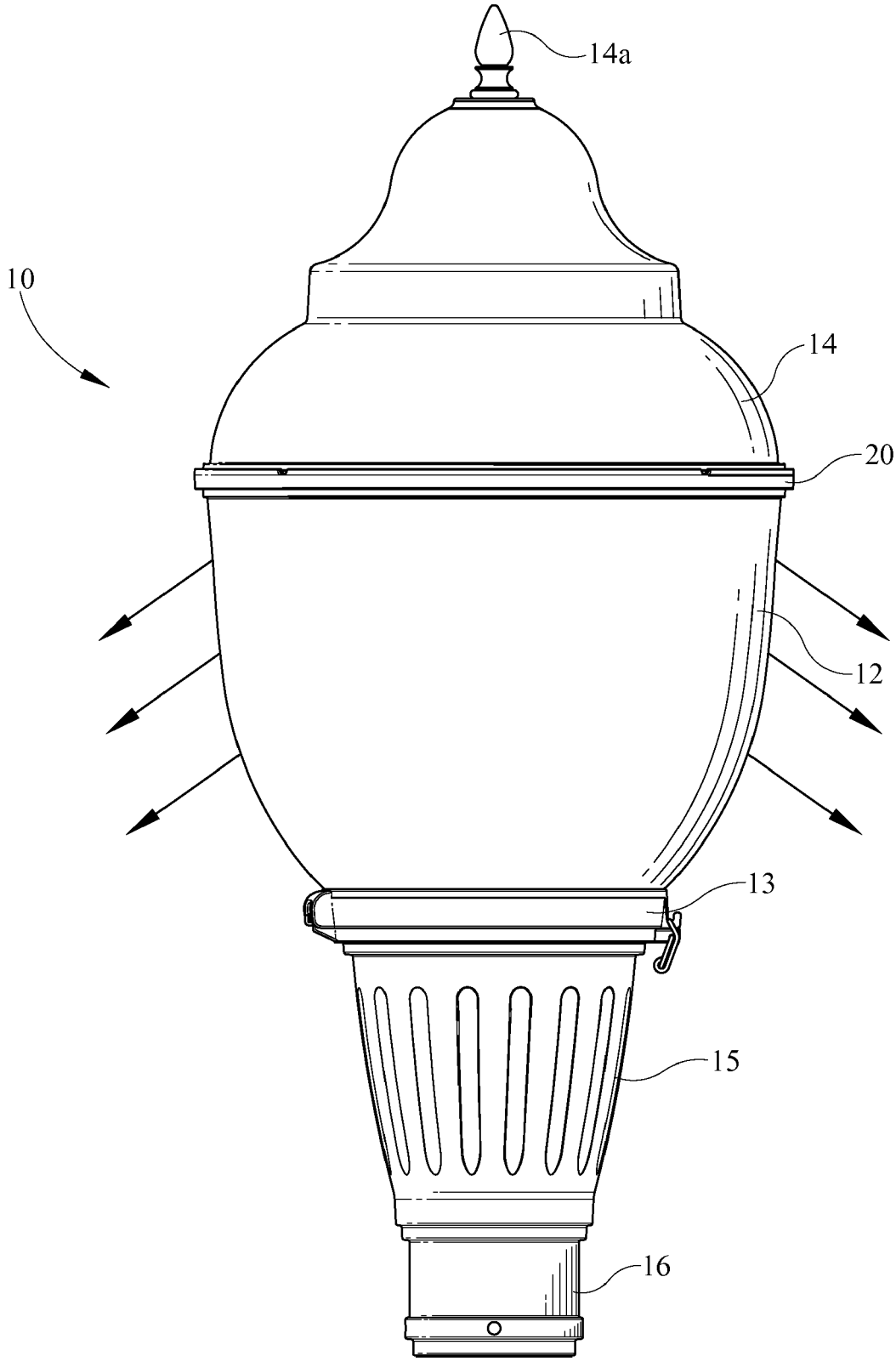
FIG. 1 depicts an external frontal view of an acorn style LED based luminaire of the present invention.

It is to be understood that the invention set forth herein and the various embodiments disclosed is not limited in its applications to the details of construction and the arrangement of components set forth in the following description or illustrated in the drawings. The invention is capable of other embodiments and of being practiced or of being carried out in various ways and in alternative constructions. Also, it is understood that the phraseology and terminology used herein is for the purpose of description and should not be regarded as limiting. Therefore, the use of "including" "comprising" or "having" and variations thereof is meant to encompass the items listed thereafter and equivalents as well as additional items. Unless limited otherwise, the term "connected" "coupled" "in communication with" and "mounted" and variations thereof are used broadly and encompassed direct and indirect connections, couplings and mountings, whether mechanical, electrical or otherwise as is known in the art. In addition, the terms "connected" and "coupled" and variations thereof are not restricted to physical or mechanical connections or couplings as the utilization described herein may be well understood to incorporate other interpretations. Furthermore, and as described in subsequent paragraphs, the specific mechanical configurations illustrated in the drawings are intended merely to exemplify the various embodiments depicted of the invention and that other alternative mechanical configurations and embodiments are possible and understood by one of ordinary skill in the art after review of the disclosure and drawings hereof.

Referring now in detail to the figures, namely FIGS. 1-7, wherein like numerals indicate like elements throughout the several views, there are shown various aspects for an acorn style LED based luminaire. Acorn style luminaires are generally known in the art and have previously been utilized with various illumination sources excluding LED's. Utilization of LED's within acorn style luminaires, particularly sealed acorn style luminaires, presents its own design characteristic and problems which must be overcome through variations of construction necessary for heat dissipation, support and structural integrity, luminosity, illumination characteristics and the like.

Referring to FIG. 1, as is shown therein, the LED based acorn style globe luminaire 10 is depicted with the top 14, globe 12, and fastening hardware 13 all of which are resting on a capital 15 which incorporates the utilization of a fastening collar 16 enabling the entire globe structure to be fastened to the upper end of a pole and the like. The acorn style globe luminaire 10 may have various designs characteristics, the most easily and readily interchangeable of which may be an opaque or translucent top 14, the implementation of both designs being readily available. As may be seen from the construction in the side view shown in FIG. 1, the globe top 14 may be fastened to the globe 12 and the fastening collar or hardware 13 through the use of various known devices which includes the utilization of a finial 14*a* allowing direct connection through mechanical affixation of the finial 14*a* directly to support post 17*a* and 17*b* as shown in the various figures.

Also, as may be seen from FIG. 1, a collar 16 may be utilized with the capital 15 in order to securely affix the acorn style luminaire 10 directly to a post top such that the entire globe may be supported in the air for proper illumination of exterior surfaces, streets and areas as are known.

As is shown in FIG. 1, fastening hardware 13 is provided for removal of the globe 12 from the fastening collar 13 as may be necessary for maintenance and other accessibility issues. As is known in the art as well, exterior acorn style globe luminaires further require adequate sealing and the like to prevent moisture intrusion into the interior globe space 19 and interior globe top space 18 (shown in FIG. 6), moisture intrusion which may damage interior electronics, optical characteristics and other aspects which are undesirable due to their effects.

Figure 2:
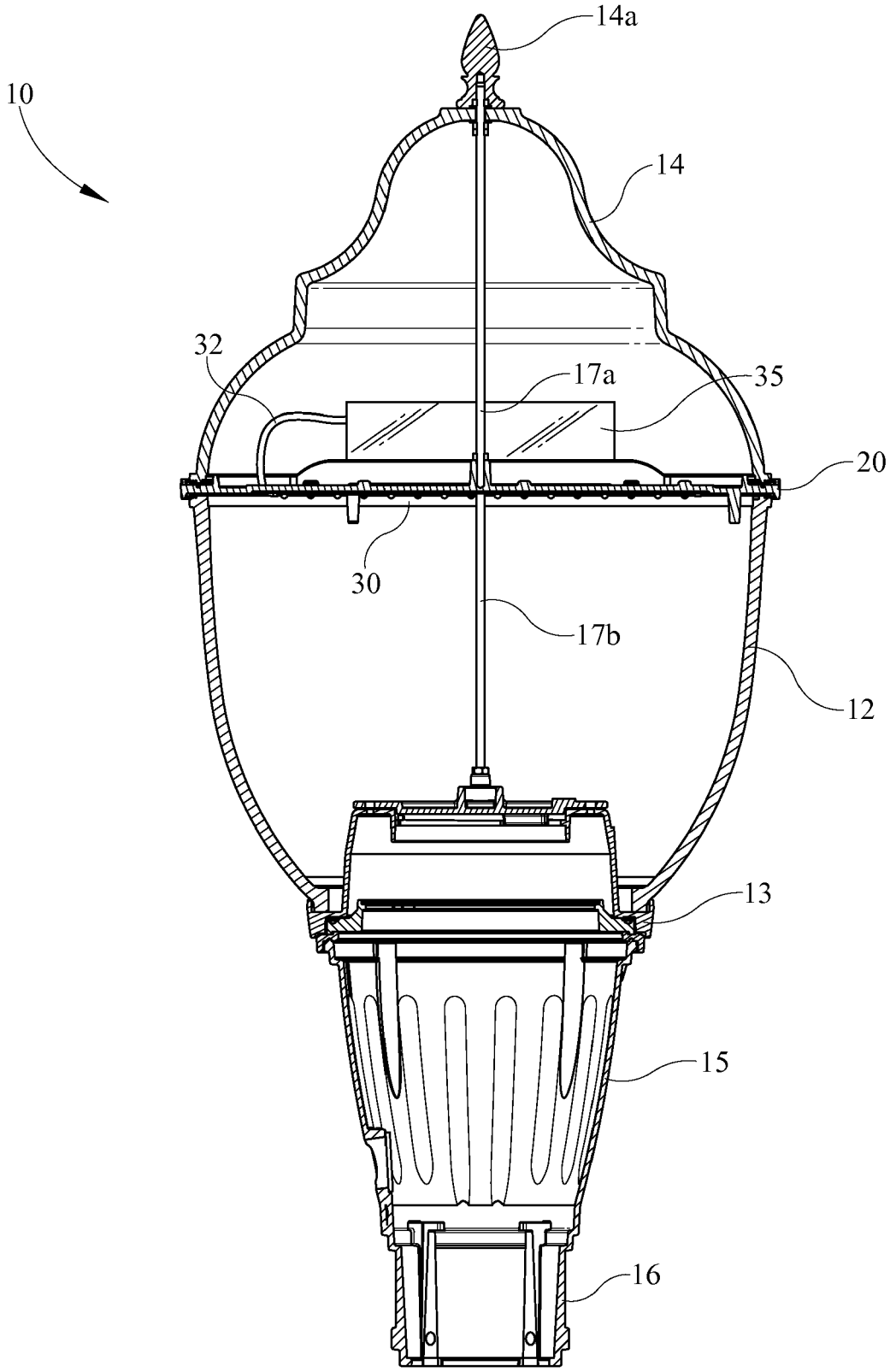
FIG. 2 is a side sectional view of an acorn style LED based luminaire of the present invention.

Turning to FIG. 2, the acorn style luminaire depicted incorporates the utilization of a heat transfer plate 20, heat transfer plate 20 being a heat conductive material such as aluminum or similar characteristic material which can support an LED board 30 thereon, the LED board 30 and the heat transfer plate 20 being in heat transfer communication therewith such that heat generated by the plurality of LED's 31 mounted on the LED plate 30 may transfer energy to the rear portion of the LED board 30 and directly to the heat transfer plate 20. Heat transfer plate 20 and LED board 30 may be mechanically affixed or coupled to one another, removably affixed, adhesively coupled or affixed in many ways as long as heat transfer is allowed between the LED board 30, individual LED 31, and the heat transfer plate 20. Also, as shown in FIG. 2, the interior construction of the exemplary embodiment of the acorn style luminaire 10 of the present invention is shown. Finial 14*a* is provided with a threaded interior to receive the upper portion of the upper support post 17*a* allowing the finial to compressively retain the globe top 14 onto the globe 12 while maintaining the heat transfer plate 20 therebetween.

In general, the construction of the acorn style luminaire may utilize an opaque or translucent top 14, the construction of which is well known in the art and may incorporate the utilization of metal, plastics, acrylic or other known materials as are well known to those of skill in the art. The globe 12 utilized in the exemplary embodiment depicted may be a prismatic globe as is known in the art, preferably limiting uplight to a minimum amount and preferably to less than two percent uplight. Variations of globe designs and prismatic are available to those of skill in the art and may be interchanged with the LED based acorn style luminaire depicted herein. There is known constructions for low uplight cut-off acorn style luminaires such as set forth in co-pending application Ser. No. 12/037,373 filed Feb. 26, 2008, the entire disclosure of which is hereby incorporated by reference. Thus, through the use of known reflectors, prismatic surfaces and combinations thereof, uplight may be restricted to the required IES classification as is necessary and particularly as is described herein, delivering high photometric performance of less than two percent uplight as may be desired.

As shown in FIG. 2, the support posts 17*a* and 17*b* allow the finial to compressively retain the various portions of the globe 10 directly to the fastening hardware or support collar 13 which may be utilized to retain the heat transfer plate 20 between the translucent or opaque top 14 and the globe portion 12. Various other constrictions may be implemented to fasten the top 14 directly to the heat transfer plate 20 and the globe 12 as are known in the arts such as through the use of hinge mechanisms, retention mechanisms and other retaining devices. Also, as is shown in FIG. 2, the LED board 30 may have an LED power and control cord 32 which is depicted as being desirably maintained within the interior of the globe 10 and which can lead to control hardware 35 shown positioned within the capital top 14 or which may be readily positioned elsewhere within the luminaire or support structure. Power supply and control hardware 35 may be electrically connected to line voltage or other power supply thrown known techniques, such as through a power line extending upward through the support pole (not shown) and through capital 15. Alternatively, control hardware may be located elsewhere within the luminaire or support structure. Various control hardware 35 may be necessary to supply proper electrical power to the LED board and the individual LED's which may require microcontroller design and power supply and control software and hardware for adequate controlling of the luminosity output thereof. Controller and power supply 32 depicted is shown positioned within the top 14 and in this example the top is opaque thereby not revealing the electronic components thereof. Alternatively, when a clear or translucent top is being utilized, power supply and control electronics 32 may be positioned elsewhere and a control line and power cord 32 leading from the electronics 35 to the LED board 30 may be utilized and hidden within the interior support structure of the acorn luminaire.

Figure 8:
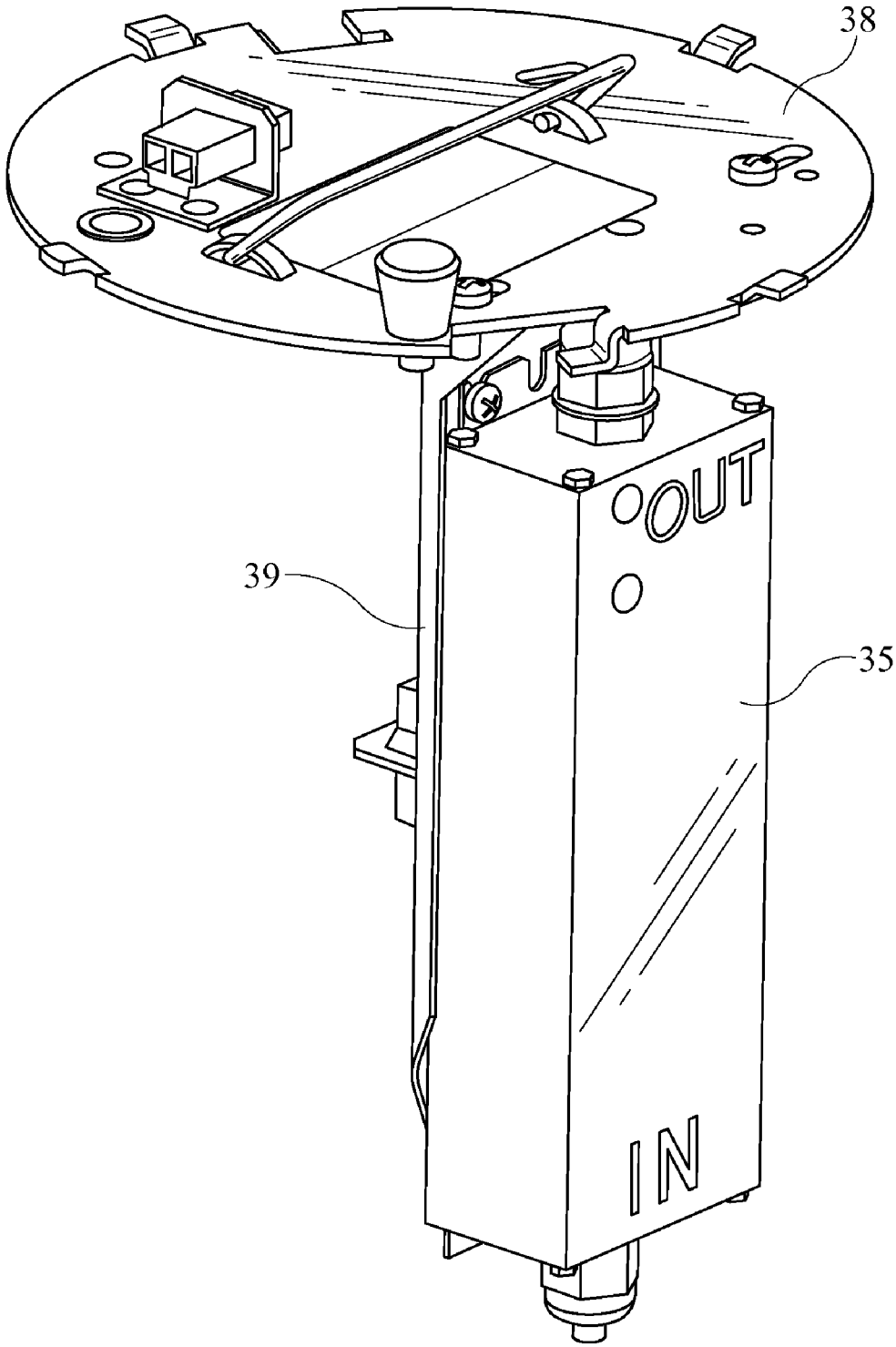
FIG. 8 is an upper perspective view of the support base plate which suspends and supports the LED driver in the luminaire of the present invention; and, FIG. 9 is a side sectional view of the luminaire of the present invention detailing the support base plate and LED driver of FIG. 8.
Figure 9:
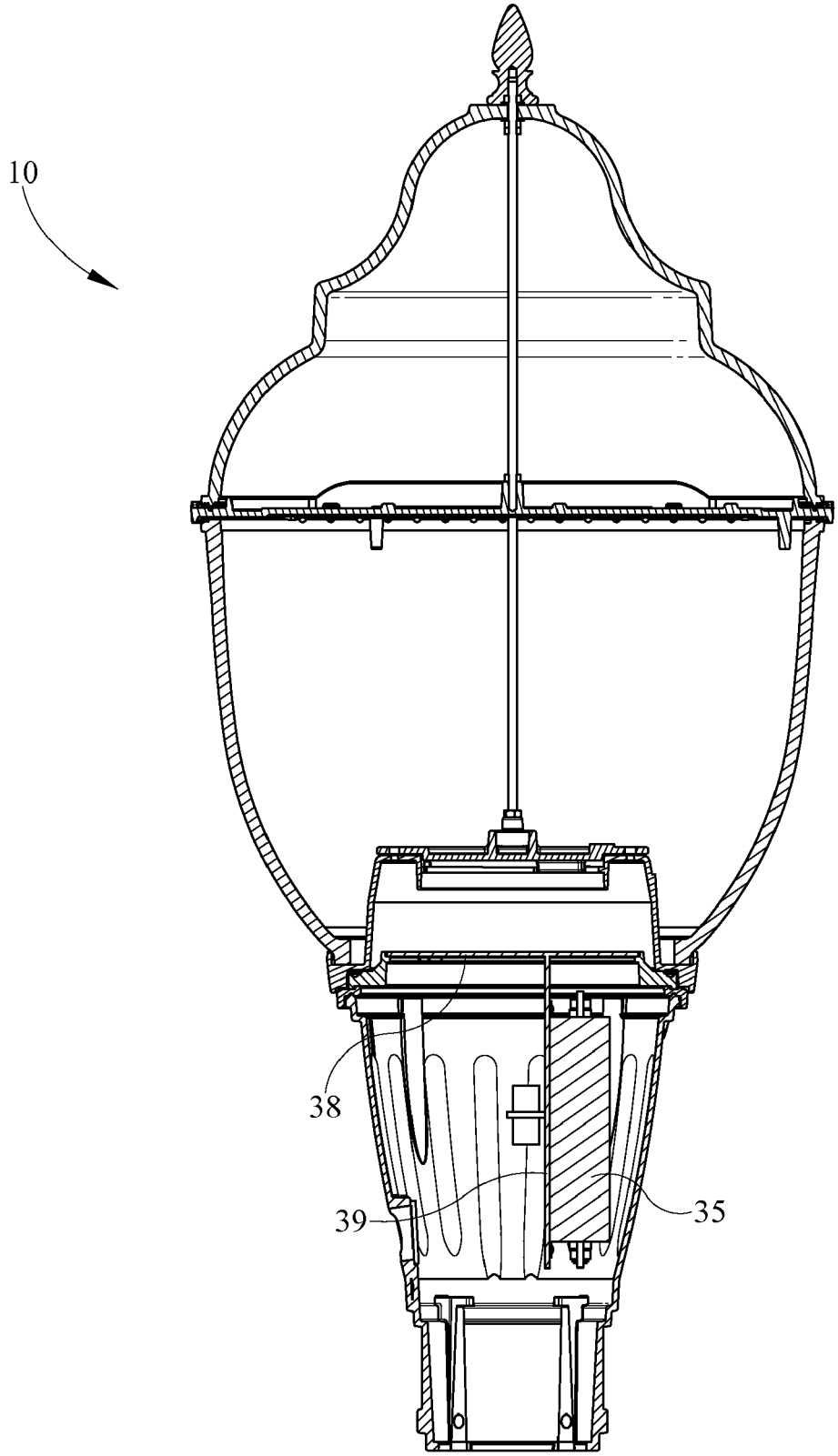

As depicted alternatively in FIGS. 8 and 9, LED driver 35 can be suspended from support or base plate 38 resting at the top of the capital and located at the lower end of the globe 12. This plate can have suspended support bracket 39 which is fastened to the driver 35. In this alternative construction, the driver can be electronically connected to the LED board 30 thereby controlling each of the LED's 31 in the globe. For clarity of depiction in FIG. 9, the control wire from the LED controller 35 to the LED board 30 located on the underside of the thermal transfer plate 20 shown in FIG. 9, is not depicted but many methods of electrical communication between the LED driver/controller 35 and the individual LED's 31 are known and may be utilized.

In this alternative construction, the driver 35 is maintained in a position away from the interior of the globe while still being accessible for maintenance either through the globe after removal of the top or through a door formed in the capital. The base plate 38 may be secured to the housing between the capital 15 and the collar 13 as shown. Many ways of securing the plate 38 however are available and may be utilized, such as tabs as depicted, bolts, fastening screws, adhesives or any other fastening or coupling mechanism required and utilized to retain the plate in position adjacent the lower edge of the globe in this example and alternative embodiment. Many methods of placement and affixation are available for use however to those of skill in the art and no specific limitation should be inferred from the example depicted in the figures. In either position of the various embodiments shown, the driver 35 maintains control of the LED's on the board 30 and is positioned to reduce the negative impact on light output.

Figure 3:
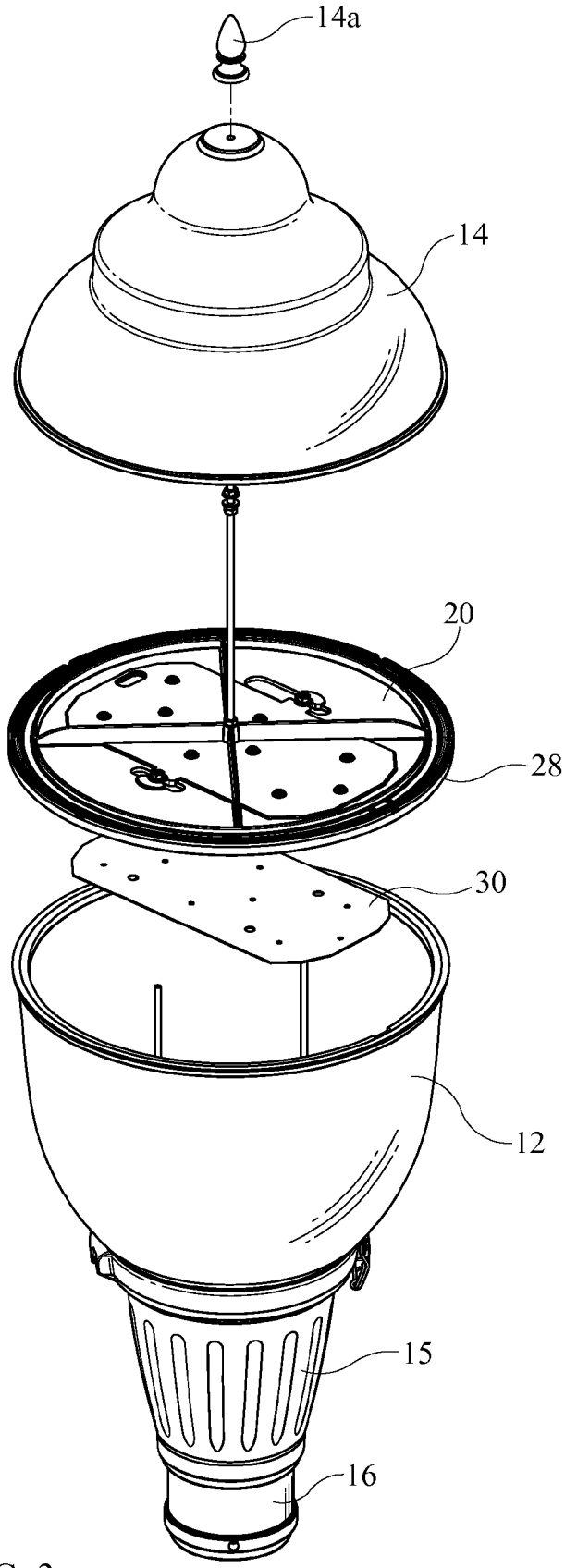
FIG. 3 is an upper perspective exploded view of the acorn style LED based luminaire of the present invention wherein some internal components are depicted.
Figure 4:
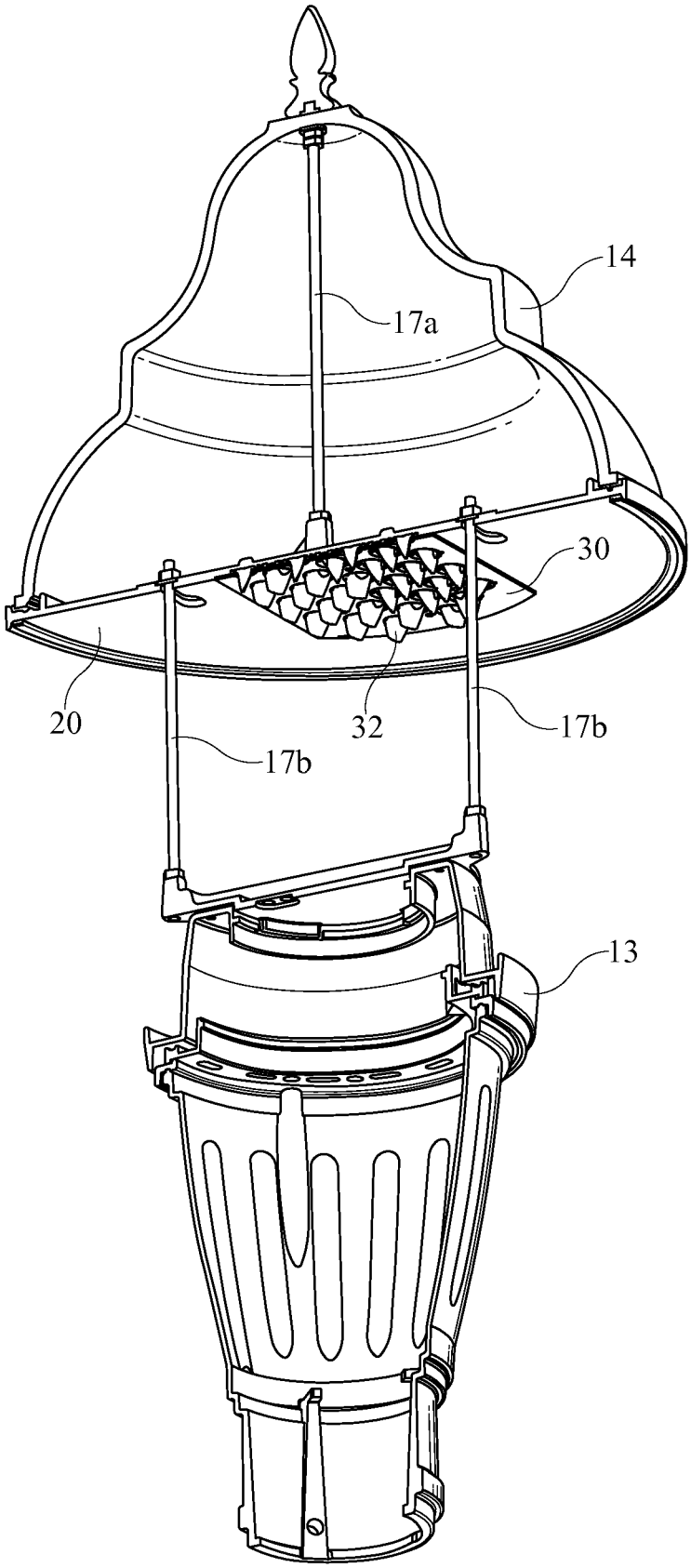
FIG. 4 is a partial lower sectional view of the acorn style LED based luminaire of the present invention with some aspects and internal components removed.

Turning to FIG. 3 and FIG. 4, the heat transfer plate 20 of the present embodiment is depicted sandwiched between the globe top 14 and the globe 12 shown. The heat transfer plate 20 is designed to support the LED board 30 which is maintained in a horizontal position on the bottom surface of the heat transfer plate 20. The LED board 30 may be in heat transfer relation to the heat transfer plate 20 or may be directly and mechanically affixed thereto and may position the plurality of LED's 31 on the LED board 30 in the downward direction as well as the plurality of rotatable and directable LED lenses 32. Further, as shown in FIG. 4, the lower support post 17*b* extends upward from the fastening hardware and collar 13 directly to the heat transfer plate 20. Centrally positioned upon the heat transfer plate 20 is the upper support post 17*a* which extends upward to the top of the acorn globe top 14 and into the finial 14*a*. Many other constructions are known and may be utilized for interconnectivity of the retention collar 13, capital 15 and top 14. Also, as is shown in FIG. 4, the fastening hardware and collar 13 directly supports the various structures of the support post 17*b* in this embodiment but alternative structures are known and available for use. Additionally, it may be desirable to maintain control electronics and power supplies directly within the interior space 18 of the globe top 14 as sown in the example of FIG. 2 and thus, additional hardware may be implemented to provide support brackets and the like for the power supply, control electronics and other necessary hardware to drive the LED's 31 positioned on LED board 30.

Returning the to the various construction figures shown, the LED board 30 is mounted or thermally connected to the heat transfer plate 20 and, as is shown in FIG. 4, a plurality of individually directable LED lenses 32 are shown directed downward and on the lower surface of the LED board 30. These lenses may be utilized to particularly direct the LED output of the individual LED's 31 on the LED board 30 as they are each rotatable and directable. Such LED lenses for an LED fixture are described in co-pending U.S. application Ser.

No. 12/171,362 filed Jul. 11, 2008, the entire disclosure of which is hereby incorporated herein by reference.

In practical use of the LED's and lenses of the present invention and as purely utilized as an example, lens 32 may direct a majority of light outputted by a LED with a Lambertian light distribution off an LED light output axis. In the vertical plane, a majority of the light may be directed within a range from approximately 50° to 75° off the light output axis. In the horizontal plane, a majority of the light may be directed within a 40° range away from the light output axis. Up to approximately 90% of light outputted by a LED with a Lambertian light distribution having the embodiment of orientable lens depicted herein may be distributed off the light output axis. Variations of this light output may be utilized depending on the output characteristics required, such as, for example, 70% off LED output axis in order to minimize up-light or keep up-light under a desired amount of, for example, 2%.

Figure 5:
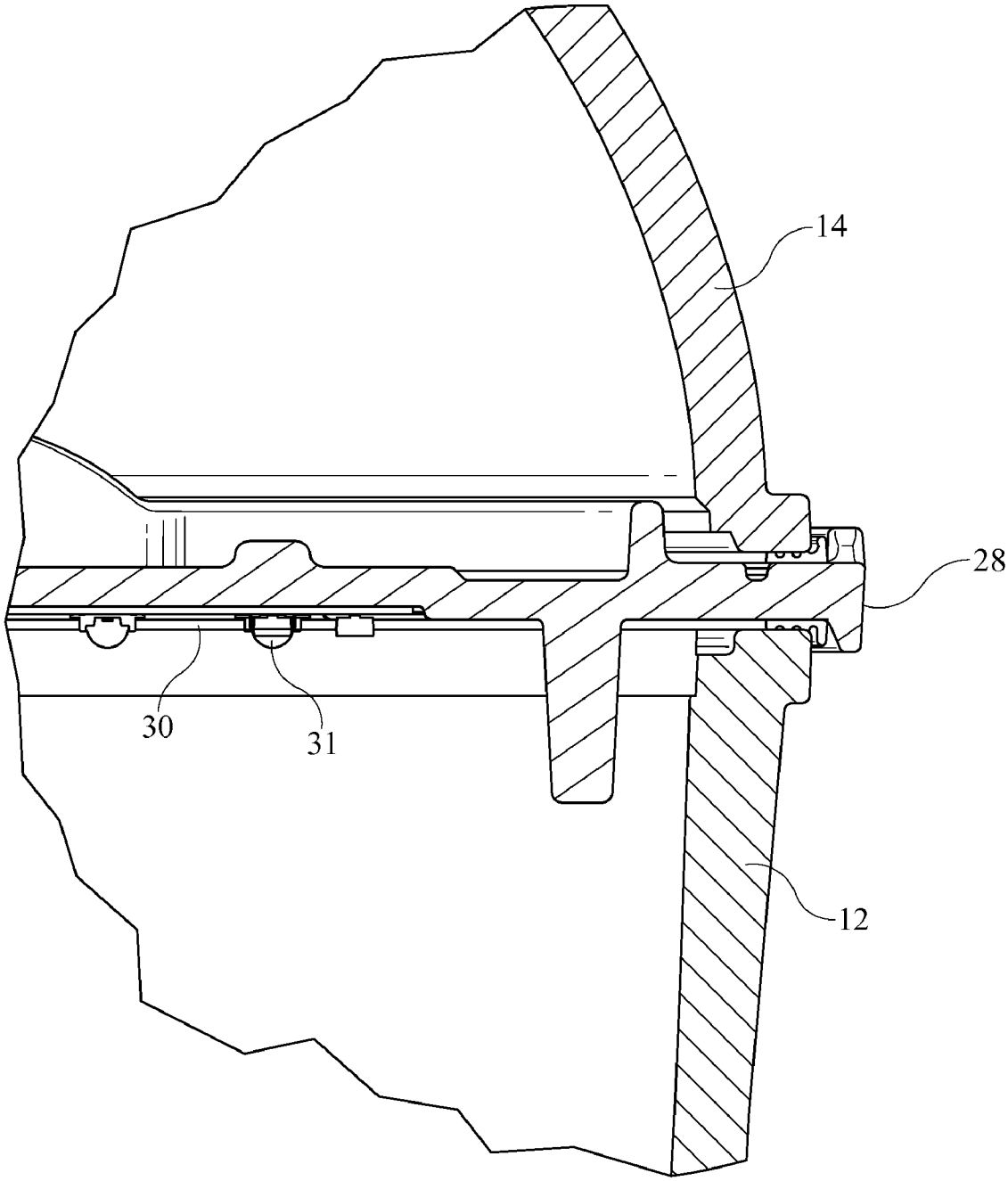
FIG. 5 is a close-up side sectional view of the accord style LED based luminaire of the present invention detailing the LED board and the heat transfer plate positioning.

As a result of the thermal mounting of the LED board 30 to the heat transfer plate 20, heat generated by the individual LED's 31 on the LED board 30, as may be shown in FIG. 5, may flow from the LED's 31 directly to the heat transfer plate 20. As is depicted in the various figures, heat transfer plate 20 extends peripherally outward to an area beyond the interior space of the globe 10 and, as is shown in the various embodiments, extends and is sandwiched between the globe top 14 and the globe portion 12. The heat transfer plate 20, shown particularly in FIG. 3 and FIG. 5, allows for the heat generated by the LED's to transfer radially outward to the exterior of the acorn style luminaire 10 through the exposed peripheral edge 28 of the heat transfer plate which is exposed on the outside of the globe while maintaining and without compromising the classic acorn style form that may be desirable. Additionally, utilizing the heat transfer plate 20, in conjunction with the support posts 17*a*, 17*b*, globe top 14 and finial 14*a*, the LED board 30 and the heat transfer plate 20 may be readily removed during maintenance or as is necessary through the globe top by removing of the top of the globe 14 which is mechanically fastened to the bottom part of the luminaire through the support posts 17*a* and 17*b*. From FIG. 4 it is apparent that after removal of the finial, the globe top 14 may be removed exposing the interior of the luminaire 10. Thermal plate 20 may be unfastened from the support posts 17*b* and removed, allowing access to the LED's and LED plate 30. Further, if LED driver is positioned in the capital 15 as depicted in FIGS. 8 and 9, support plate 38 may be removed through an aperture in collar 13 by handle visible in FIG. 8 thus allowing all electrical components including the LED driver 35.

Figure 7:
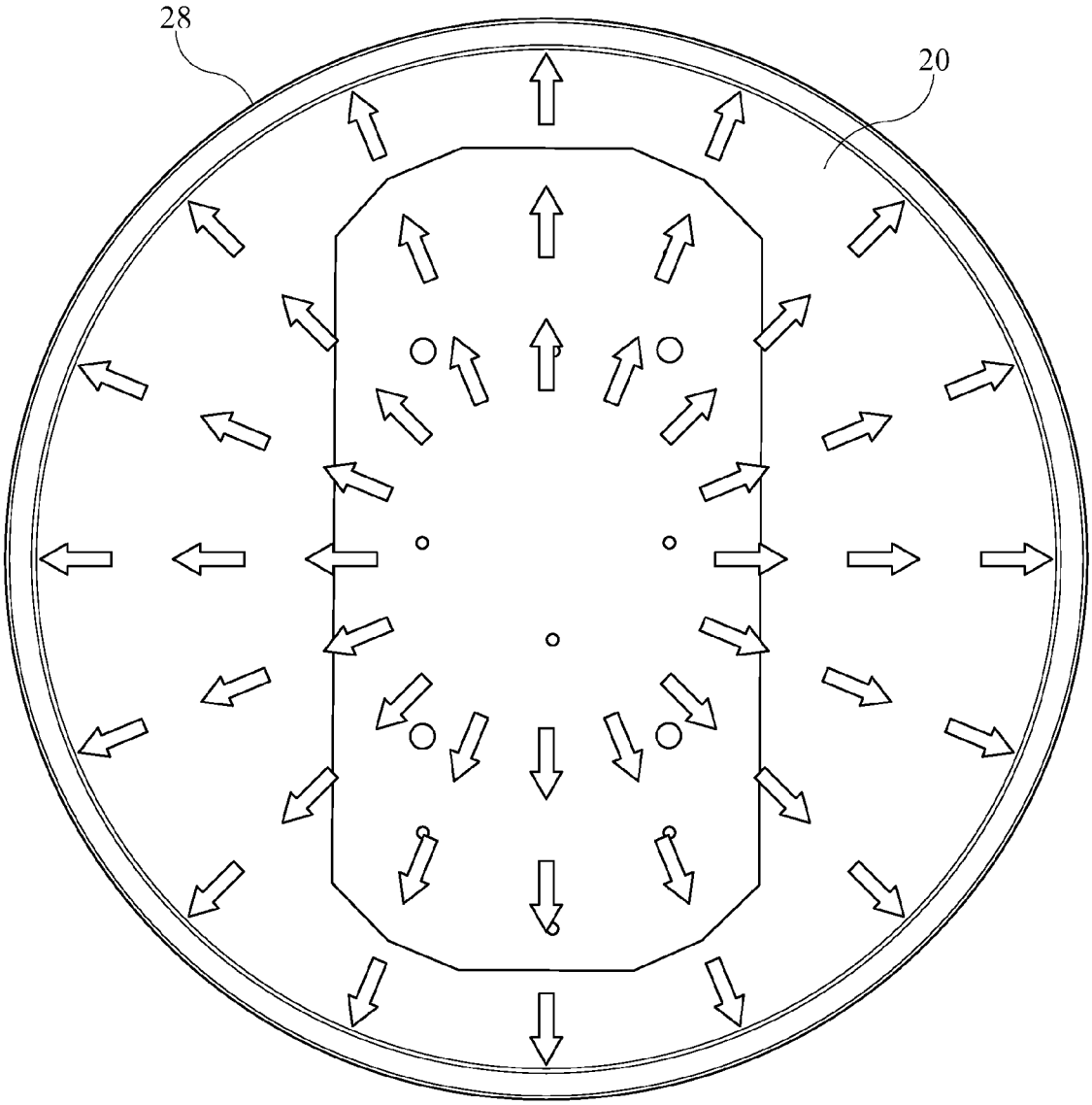
FIG. 7 is a top view of the heat transfer plate utilized to support the LED's within the acorn style LED based luminaire of the present invention.

LED board 30 may incorporate the utilization of up to or more than 54 LED light sources variously positioned on the LED board and placed to provide downlight when the LED board 30 is installed in the horizontal position on the lower surface of heat transfer plate 20. The plurality of LED optical lenses 32 shown in FIG. 4, work in conjunction with the LED 31 and the globe 12 in order to deliver high photometric performance of less than two percent uplight while also allowing the heat generated by the LED board and the individual LED's to be dissipated along the exposed peripheral edge 28 of the heat transfer plate 20 exposed on the exterior of the acorn style luminaire 10. It is preferable that for the LED's 31 to be fully efficient and operate at maximum output, heat generated from the LED light source is evacuated from the interior of the fixture as depicted in FIG. 7, the heat transfer plate 20 acting to radially dissipate heat generated by the LED's outward to the exposed peripheral edge 28 of the plate 20 or merely outward and away from the LED support base 30. The substantially round platform or support plate 20 transfers and allows thermal dissipation of the heat generated by the LED's to the outside or the exterior of the acorn style luminaire without compromising the classic acorn form and maintaining aesthetic integrity of the acorn style luminaire 10 but also maintaining electronic functionality of the LED's located therein.

Figure 6:
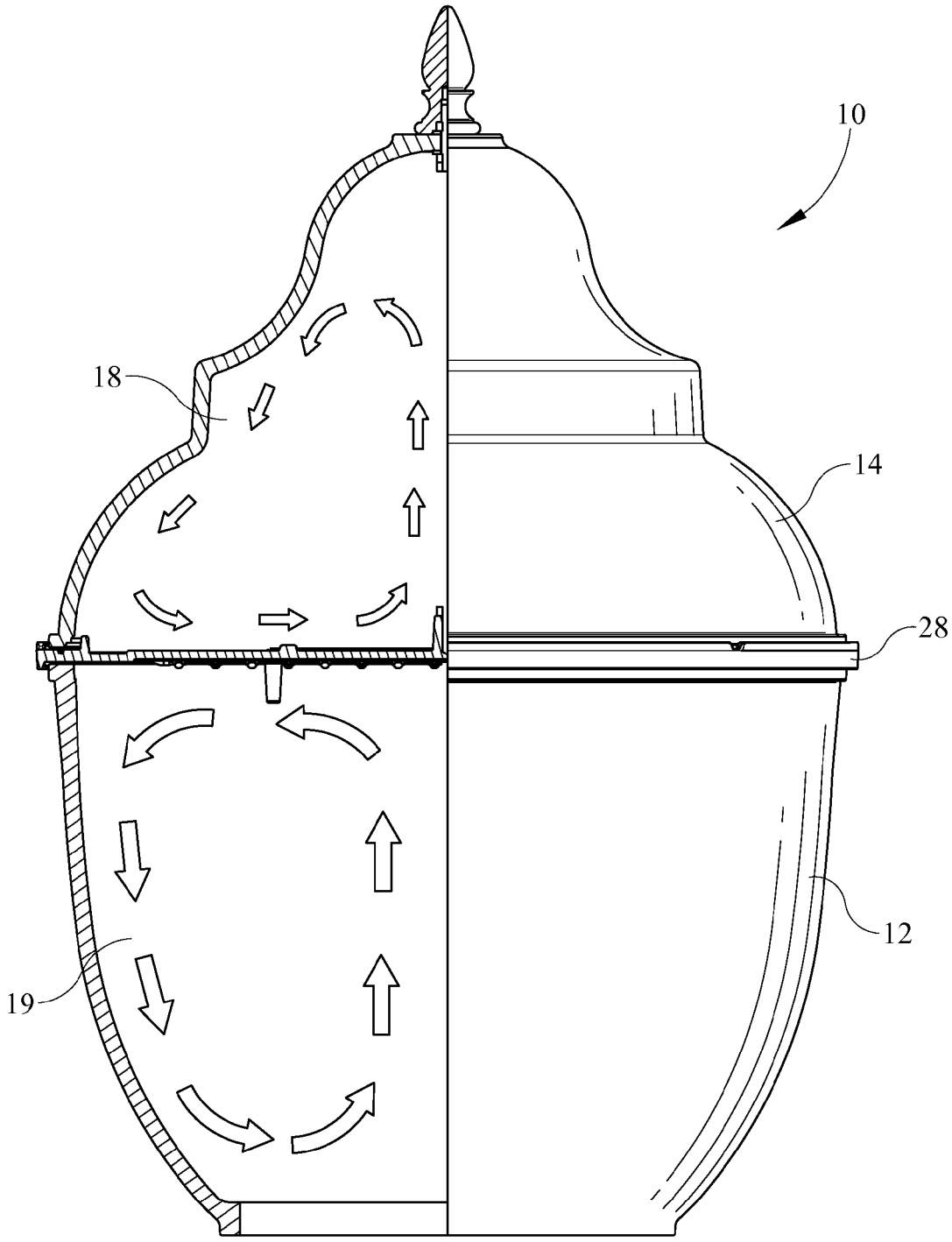
FIG. 6 is a partial side sectional view of the LED based acorn style luminaire depicting airflow characteristics and heat transfer within the luminaire of the present invention.

As shown in FIG. 6, within the globe interior space 19 of globe portion 12 thermal flow of the head generated circulates in a fashion as depicted through normal cooling and heating cycles. Similarly, within the globe top interior space 18, similar patters may be seen as is shown in the figure. Through implementation of the radial heat dissipation shown in FIG. 7, significant heat may be dissipated exterior of the luminaire away from the individual LED's and the LED base board to allow them to work efficiently and to maintain their electronic functionality all while maintained enclosed within the acorn style globe 10. As is shown, utilization of the individual lenses 32 which may be individually orientable, up to or more than seventy percent of the light output may be directed in the off-axis beam with less than two percent uplight. As shown, the LED board is positioned in a horizontal orientation and fastened to the globe as described.

Various portions of the globe including the lower globe portion 12 and the globe top 14 may be made of glass, plastic, acrylic or like known materials. As depicted, globe top 14 may be translucent or opaque and may utilize known constructions of plastic, glass, metals or other required material which creates desired optical characteristics. In order to provide access to the interior of the globe and to the LED control electronics and to the LED board, lamp finial 14*a* may be removed from the upper support post 17*a* allowing the acorn style globe top 14 to be removed therefrom thereby exposing the heat transfer plate 20. Heat transfer plate 20 may thereafter be directly removed after unfastening of the securing mechanisms fastening the plate 20 to the support posts 17*b* shown in FIG. 4. The entire heat transfer or support plate or round platform 20 may directly be removed in order to gain access to the LED's and LED lenses. As indicated, control electronics for the LED's may be positioned in the interior 18 of the globe top 14 supported on a support bracket, not shown. The controller and/or power supply may alternatively be located elsewhere within the capital 15, support structure or other position with a control line leading directly to the LED board 30. Preferably, any positioning of the LED electronics to power and control the LED's minimizes intrusion of such electronics on the optical performance of the globe style luminaire. Further, a clear globe acorn style appearance may be utilized for both the top 14 and lower portion globe 12 as are aesthetically desired.

In the design of the LED based acorn style luminaire depicted herein, a plurality of LED's having individually orientable lenses may be implemented on the interior of the acorn style globe. The individual lenses may be utilized in conjunction with an acrylic prismatic globe or other translucent globe to maintain optical characteristics desirable in traditional acorn style luminaires. These plurality of LED's may also be utilized in combination with a heat transfer plate directly affixed or in heat transfer communication with the planer surface supporting the LED's. Such heat transfer plate allows the radial heat dissipation from the interior of the globe of the heat generated from the LED's directly to the exterior of the globe by positioning the heat transfer plate in between the globe top and the globe bottom. Exposing a portion of the heat transfer plate along the periphery of the acorn style luminaire allows exterior heat radiation maintaining adequate heat control within the interior of the globe luminaire while also allowing LED functionality to continue at high efficiency.

While the present invention has been shown and described herein in what are considered to be various embodiments thereof, the invention is not limited to these depictions and mechanical constructions shown in the figures. Thus, various forms of the invention shown and described herein are taken as illustrative only and other embodiments may be selected without the parting from the scope and teachings of the present invention depicted and described herein and as are set forth in the appended claims.

The invention claimed is:

1. An acorn style luminaire having an LED light source, comprising:

a globe having a globe interior space, said globe coupled to a capital by a retention collar, said globe having a globe top;

a heat transfer plate positioned between said globe and said globe top and having a radial edge exposed exterior surface between said globe top and said globe;

said heat transfer plate affixed to a lower support post and to an upper support post, said lower support post extending downward from said heat transfer plate to said retention collar, said upper support post extending from said heat transfer plate to said globe top;

a planar LED support surface having a plurality of LED's, said support surface thermally mounted to said heat transfer plate allowing heat generated by said plurality of LED's to extend radially outward on said heat transfer plate to said exposed radial edge and, wherein said heat transfer plate has a planar mounting surface for receiving said LED support surface, said planar mounting surface of said heat transfer plate contacting substantially all of said planar LED support surface to allow substantially all of said LED support surface to thermally transfer heat to said heat transfer plate.

2. The acorn style luminaire of claim 1 wherein each of said plurality of LED's on said support surface has an orientable lens which directs light emitted from each of said LEDs.

3. The acorn style luminaire of claim 2 wherein the light output from said plurality of LED's and LED lenses redirects the light output such that about seventy percent of the light output of said plurality of LED's is directed off of an axis of illumination of each of said LEDs.

4. The acorn style luminaire of claim 3 wherein said light output includes less than about two percent uplight.

5. The acorn style luminaire of claim 1 wherein said heat transfer plate is an annular support plate supporting and directing said plurality of LED's in the downward direction away from said globe top.

6. The acorn style luminaire of claim 1 wherein said plurality of LED is electrically connected to an LED controller mounted on an upper surface of said heat transfer plate in an interior space defined by said globe top.

7. The acorn style luminaire of claim 1 wherein said globe is a prismatic acrylic globe.

8. The acorn style luminaire of claim 1 wherein a support base plate is positioned between said capital and said globe, said support base plate having a depending support bracket for supporting LED driver electronics, said LED driver electronics in electrical communication with said plurality of LED's.

9. An acorn style luminaire having an LED light source, comprising:

a globe mounted to a capital by a globe retention collar, said globe having a separable globe top;

a heat transfer plate having a planar mounting surface and positioned between said globe and said globe top and having a radial edge exposed exterior surface between said globe top and said globe;

a substantially flat planar LED support surface having a plurality of LED's, said support surface thermally mounted to said planar mounting surface of said heat transfer plate allowing heat generated by said plurality of LED's to extend radially outward on said heat transfer plate to said exposed radial edge;

said heat transfer plate planar mounting surface substantially contacting and surrounding said LED support surface to allow heat to transfer from said LED support surface to said heat transfer plate along substantially its entire surface; and, a support base plate positioned between said capital and said globe, said support base plate having a depending support bracket for supporting LED driver electronics, said LED driver electronics in electrical communication with said plurality of LED's.

10. An acorn style luminaire having an LED illumination source, comprising:

a globe and a globe top forming an interior;

a thermal transfer plate supporting an LED support sheet directing a plurality of LED's away from said globe top and through said globe;

said thermal transfer plate conducting heat away from said LED support sheet and to an exteriorly exposed peripheral edge, said exteriorly exposed peripheral edge exposed between said globe and said globe top;

an LED driver in electrical communication with said LED support sheet and said plurality of LED's to control the luminosity and optical characteristics of said acorn style luminaire;

wherein said thermal transfer support plate has an upper surface and a lower surface, said lower surface supporting said LED support sheet; and, further comprising a support base plate positioned under said globe and supporting a controller support bracket, said controller support bracket suspending said LED driver within a capital below said globe.

11. The luminaire of claim 10 wherein said capital is affixed to a globe retaining collar retaining a lower edge of said globe, said globe retaining collar affixed to an upper portion of said capital, said support base plate positioned a manner to suspend said LED driver in an interior space of said capital.

12. The luminaire of claim 11 further comprising a lower support post extending from said globe retaining collar upwards to said thermal transfer plate, said thermal transfer plate affixed to an upper support post extending to a point of affixation to said globe top.

* * * * *